US011043320B2

(12) United States Patent
Kamiya et al.

(10) Patent No.: US 11,043,320 B2
(45) Date of Patent: Jun. 22, 2021

(54) DUST CORE

(71) Applicant: TDK CORPORATION, Tokyo (JP)

(72) Inventors: Masahiro Kamiya, Tokyo (JP); Yasuhide Yamashita, Tokyo (JP); Chiomi Sato, Tokyo (JP); Yousuke Futamata, Tokyo (JP); Ryoma Nakazawa, Tokyo (JP); Takeshi Takahashi, Tokyo (JP); Hiroyuki Ono, Tokyo (JP)

(73) Assignee: TDK CORPORATION, Tokyo (JP)

( * ) Notice: Subject to any disclaimer, the term of this patent is extended or adjusted under 35 U.S.C. 154(b) by 366 days.

(21) Appl. No.: 15/915,901

(22) Filed: Mar. 8, 2018

(65) Prior Publication Data

US 2018/0294084 A1 Oct. 11, 2018

(30) Foreign Application Priority Data

Mar. 9, 2017 (JP) ..... JP2017-045489
Mar. 6, 2018 (JP) ..... JP2018-039968

(51) Int. Cl.

| | |
|---|---|
| ***H01F 1/24*** | (2006.01) |
| ***H01F 1/33*** | (2006.01) |
| ***H01F 3/08*** | (2006.01) |
| ***B22F 1/02*** | (2006.01) |
| ***H01F 41/02*** | (2006.01) |
| ***C22C 38/02*** | (2006.01) |
| *H01F 1/26* | (2006.01) |

(52) U.S. Cl.

CPC ..... *H01F 1/24* (2013.01); *B22F 1/02* (2013.01); *B22F 1/025* (2013.01); *C22C 38/02* (2013.01); *H01F 1/33* (2013.01); *H01F 3/08* (2013.01); *H01F 41/02* (2013.01); *H01F 41/0246* (2013.01); *B22F 2998/10* (2013.01); *C22C 2202/02* (2013.01); *H01F 1/26* (2013.01)

(58) Field of Classification Search

None

See application file for complete search history.

(56) References Cited

U.S. PATENT DOCUMENTS

| | | | | |
|---|---|---|---|---|
| 2002/0158739 | A1* | 10/2002 | Shibata | H01F 41/0246 336/90 |
| 2008/0029300 | A1* | 2/2008 | Harada | H01F 41/0246 174/391 |
| 2008/0152897 | A1 | 6/2008 | Maeda et al. | |

FOREIGN PATENT DOCUMENTS

| | | | |
|---|---|---|---|
| CN | 101107681 | A | 1/2008 |
| JP | 3624681 | B2 | 3/2005 |
| JP | 2009-120915 | A | 6/2009 |
| JP | 5190331 | B2 | 4/2013 |

* cited by examiner

*Primary Examiner* — Xiaowei Su
(74) *Attorney, Agent, or Firm* — Oliff PLC

(57) ABSTRACT

A dust core includes a metal magnetic material, a resin, and an insulation film. The insulation film contacts with a surface of the metal magnetic material and covers the metal magnetic material. The insulation film includes a first film and a second film. The first film contacts with the surface of the metal magnetic material. The second film contacts with a surface of the first film. A density of the first film is higher than a density of the second film.

19 Claims, 3 Drawing Sheets

DUST CORE

BACKGROUND OF THE INVENTION

1. Field of the Invention

The present invention relates to a dust core.

2. Description of the Related Art

Motors and coil devices, such as inductors, choke coils, and transformers, have been required to be downsized, and widely used is thereby a metal magnetic material whose saturation magnetic flux density is larger than that of ferrite and whose DC superposition characteristics are maintained until high magnetic field. Here, pressure molding is needed to mold the metal magnetic material into a desired shape. When pressure molding is carried out, however, distances among the metal magnetic material become uneven, and some of the metal magnetic material are excessively close to each other. As a result, magnetic saturation is easily generated during magnetic application, and DC superposition characteristics deteriorate relatively.

Thus, considered have been various measures to prevent some of the metal magnetic material from being excessively close to each other.

Patent Document 1 discloses that a metal magnetic material is covered with inorganic coat (phosphate), but phosphate has a low toughness, and a coating film may be broken when molding pressure is increased.

Patent Document 2 discloses that a surface of a metal magnetic material is coated with resin, but resin has softness, and it thereby moves during heat treatment after molding, and the metal magnetic material may excessively be close to each other.

Patent Document 3 discloses that MgO particles as spacing materials are contained so as to increase distances among a metal magnetic material, but MgO particles are extremely fine, have a high aggregability, and are thereby hard to be dispersed uniformly in a dust core. When MgO particles are not dispersed uniformly, the metal magnetic material may excessively be close to each other in part where less MgO particles are present.

Patent Document 1: JP2009120915 (A)
Patent Document 2: JP5190331 (B2)
Patent Document 3: JP3624681 (B2)

SUMMARY OF THE INVENTION

The present invention has been achieved under such circumstances. It is an object of the invention to provide a dust core excelling in DC superposition characteristics.

To achieve the above object, the dust core according to the present invention comprises:

a metal magnetic material;

a resin; and an insulation film contacting with a surface of the metal magnetic material and covering the metal magnetic material, wherein the insulation film comprises:

a first film contacting with a surface of the metal magnetic material; and a second film contacting with the surface of the first film, and wherein a density of the first film is higher than a density of the second film.

The dust core according to the present invention has the above features, and is thereby excellent in DC superposition characteristics.

Preferably, each of the first film and the second film comprises a Si—O based oxide.

The first film and the second film may comprise different contrasts from each other observed by TEM.

Preferably, $1.25<I_1/I_2<10.0$ is satisfied, where $I_1$ is a Si detection intensity of the first film, and $I_2$ is a Si detection intensity of the second film, in TEM-EDS analysis of the first film and the second film.

Preferably, $0.075<D_1/D_2<10.0$ is satisfied, where $D_1$ is a thickness of the first film, and $D_2$ is a thickness of the second film.

The metal magnetic material may comprise a main component of Fe.

The metal magnetic material may comprise a main component of Fe and Si.

DETAILED DESCRIPTION OF THE PREFERRED EMBODIMENT

Hereinafter, an embodiment of the present invention is described based on figures.

Figure 1:
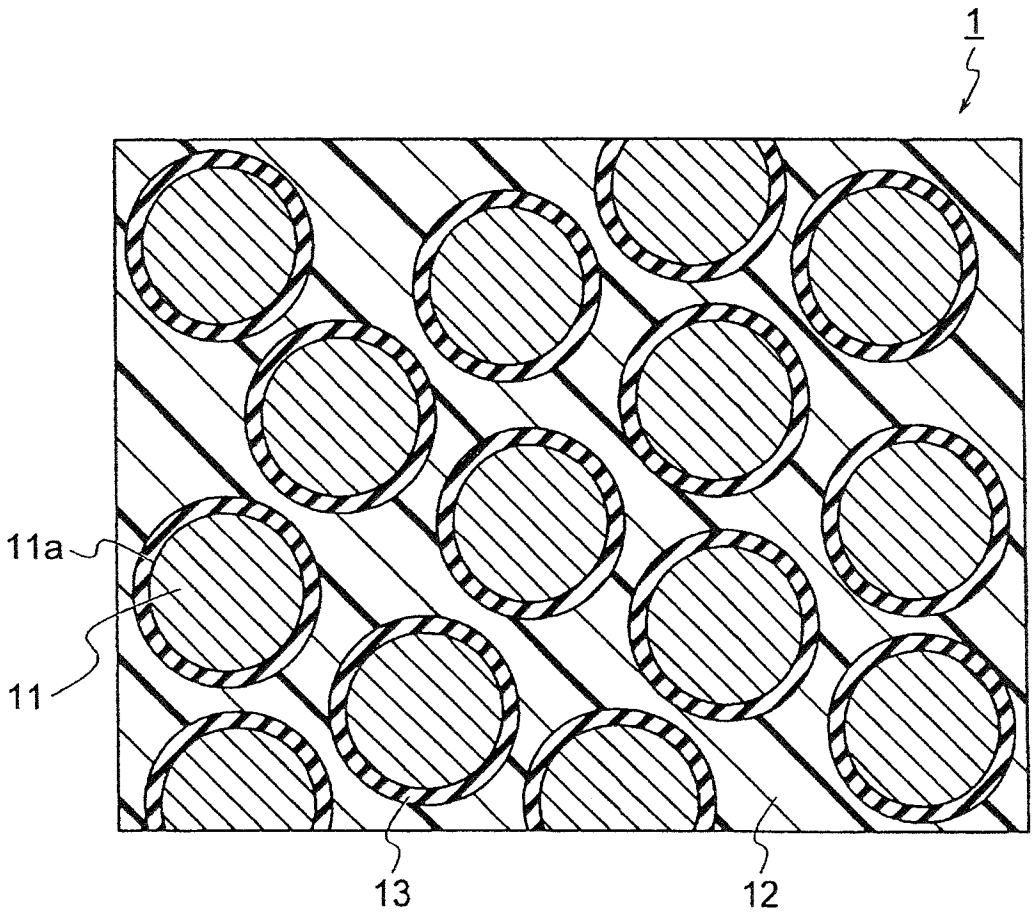
FIG. 1 is a schematic view of a cross section of a dust core according to an embodiment of the present invention.

As shown in FIG. 1, a dust core 1 according to the present embodiment includes a metal magnetic material 11 and a resin 12. Moreover, the dust core 1 includes an insulation film 13 contacting with a surface 11*a* of the metal magnetic material 11 and covering the metal magnetic material 11.

The metal magnetic material 11 comprises any component, but preferably comprises a main component of Fe because high saturation magnetization is obtained. Preferably, the metal magnetic material 11 includes a main component of Fe and Si because a high permeability is obtained. Incidentally, "a main component is included" in the present embodiment means that an amount of the main component is 80 wt % or more in total provided that the amount of the entire metal magnetic material is 100 wt %. That is, when Fe is included as a main component, a Fe content is 80 wt % or more. When Fe and Si are included as a main component, a Fe and Si content is 80 wt % or more in total. Fe and Si may be included at any ratio, but Si/Fe=0/100 to 10/90 is preferably satisfied by weight ratio because high saturation magnetization is obtained. Incidentally, any other components other than the main component, such as Ni and Co, may be included in the metal magnetic material of the present embodiment.

The resin 12 may be any resin, such as epoxy resin of cresol novolac etc. and/or imide resin of bismaleimide etc.

Any amount of the metal magnetic material 11 and the resin 12 may be contained in the dust core 1. With respect to the whole of the dust core 1, the amount of the metal magnetic material 11 is preferably 90 wt % to 98 wt %, and the amount of the resin 12 is preferably 2 wt % to 10 wt %.

As shown in FIG. 1, the insulation film 13 is characterized by contacting with the surface 11*a* of the metal magnetic material 11 and covering the metal magnetic material 11.

The insulation film 13 may not cover the whole of the surface 11*a* of the metal magnetic material 11, but should cover 90% or more of the whole of the surface 11*a* of the metal magnetic material 11. This feature can enhance rust-proof effect.

Figure 2:
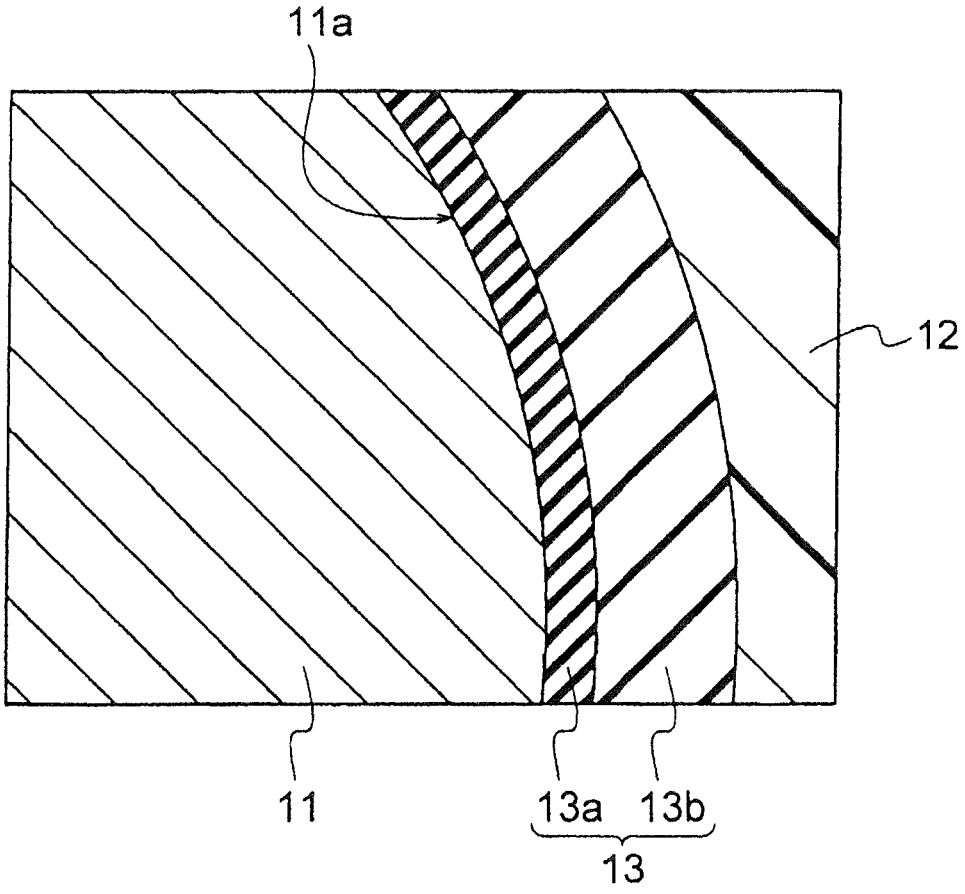
FIG. 2 is a schematic view near a surface of a metal magnetic material constituting the dust core shown in FIG. 1.

FIG. 2 is an enlarged schematic view near the surface of the metal magnetic material 11 of FIG. 1. The insulation film 13 according to the present embodiment comprises a first film 13*a* and a second film 13*b*. The first film 13*a* is in contact with the surface 11*a* of the metal magnetic material 11, and the second film 13*b* is in contact with a surface of the first film 13*a*.

In the metal magnetic material 11 according to the present embodiment, a density of the first film 13*a* is higher than a density of the second film 13*b*. That is, the first film 13*a* is a "dense film", and the second film 13*b* is a "sparse film". It is normally considered that a "space film" has a high cushioning property and a "dense film" has a high uniformity. The insulation film 13 according to the present embodiment comprises a "dense film" in contact with the metal magnetic material 11 and a "sparse film" outside the "dense film", and thereby achieves both cushioning property and uniformity. This is considered to allow each distance among the metal magnetic material 11 to be maintained at a relatively regular interval. As a result, it is considered that magnetic saturation during application of magnetic field is generated comparatively uniformly, and that DC superposition characteristics are favorable.

The first film 13*a* may not contact with the whole of the surface 11*a* of the metal magnetic material 11, but should contact with 90% or more of the whole of the surface 11*a* of the metal magnetic material 11. The second film 13*b* may not contact with the entire surface of the first film 13*a*, but should contact with 90% or more of the entire surface of the first film 13*a*.

The first film 13*a* and the second film 13*b* are made of any material. Preferably, both of the first film 13*a* and the second film 13*b* comprise a Si—O based oxide. Hereinafter, described are both of the first film 13*a* and the second film 13*b* comprising the same type of Si—O based oxide.

Incidentally, the Si—O based oxide may be any oxide, such as a Si oxide like $SiO_2$ and a composite oxide including Si and other elements.

The first film 13*a* and the second film 13*b* can be distinguished from each other when they are observed by Transmission Electron Microscopy (TEM) and have different contrasts. Even if the first film 13*a* and the second film 13*b* are made of the same material, they have different contrasts when they have different densities. Then, when the first film 13*a* and the second film 13*b* are made of the same material, they have a comparatively darker visual field as their density is higher, and they have a comparatively brighter visual field as their density is lower. In the dust core 1 according to the present embodiment, the first film 13*a* has a relatively darker visual field.

Moreover, a Si detection intensity can be measured by observation of the first film 13*a* and the second film 13*b* with Energy Dispersive X-ray Spectroscopy (TEM-EDS). The Si detection intensity reflects an abundance ratio of Si. That is, when the first film 13*a* and the second film 13*b* are made of the same material, the Si detection intensity is higher as their density is higher. In the dust core 1 according to the present embodiment, $1.25<I_1/I_2<10.0$ is preferably satisfied, where $I_1$ is a Si detection intensity of the first film 13*a*, and $I_2$ is a Si detection intensity of the second film 13*b*, because DC superposition characteristics are further improved while both of cushioning property and uniformity are achieved. When $I_1/I_2$ is too low, it is hard to achieve cushioning property and uniformity at the same time, and DC superposition characteristics easily deteriorate. When $I_1/I_2$ is too high, the dense film (first film 13*a*) is easily broken during die molding, and DC superposition characteristics thereby easily deteriorate. Moreover, $1.26\leq I_1/I_2\leq 9.92$ may be satisfied. Incidentally, $I_1$ and $I_2$ are an average Si detection intensity measured by randomly determining at least five or more, preferably 10 or more, measurement points on each film.

The first film 13*a* and the second film 13*b* have any thickness, but $0.075<D_1/D_2<10.0$ is preferably satisfied, where $D_1$ is a thickness of the first film 13*a*, and $D_2$ is a thickness of the second film 13*b*. When $D_1/D_2$ is within the above numerical range, distances among the metal magnetic material 11 easily become uniform, and DC superposition characteristics are further favorable. Incidentally, $D_1$ and $D_2$ are an average thickness measured by randomly determining at least five or more, preferably 10 or more, measurement points on each film.

A method of manufacturing a dust core 1 according to the present embodiment is described below, but the dust core 1 is not limited to being manufactured by the following method.

First, metal particles to be a metal magnetic material 11 are manufactured. The metal particles are manufactured by any method, such as gas atomization method and water atomization method. The metal particles have any particle size and any circularity, but their particle size preferably has a median (D50) of 1 μm to 100 μm because a high permeability is obtained.

Next, the metal magnetic material 11 is coated to form a first film 13*a* comprising a Si—O based oxide. The metal magnetic material 11 is coated by any method, such as a method of applying an alkoxysilane solution to the metal magnetic material 11. The alkoxysilane solution is applied to the metal magnetic material 11 by any method, such as wet spray. The alkoxysilane is any kind, such as trimethoxysilane. The alkoxysilane solution has any concentration, but preferably has a concentration of 50 wt % to 95 wt %. The alkoxysilane solution has any solvent, such as water and ethanol.

The powder after wet spray is heated at 750 to 1000° C. for 3 to 12 hours, and the first film 13*a* comprising a Si—O based oxide is thereby formed.

Next, the alkoxysilane solution used for formation of the first film 13*a* is once again wet sprayed. Then, the powder after wet spray is once again heated at 400 to 600° C. for 0.5 to 2 hours, and a second film 13*b* comprising a Si—O based oxide is thereby formed.

At this time, controlling the heating temperature and time can control densities of the first film 13*a* and the second film 13*b* to be obtained, and can further control $I_1/I_2$. Specifically, the densities are higher as the heating temperature is higher, and the densities are higher as the heating time is longer. Incidentally, when the heating time for formation of the first film 13*a* and/or the second film 13*b* is short, the density of the first film 13*a* and/or the second film 13*b* decreases, but the film thickness of the first film 13*a* and/or the second film 13*b* does not change greatly, and the volume of the first film 13*a* and/or the second film 13*b* does not change greatly either. This shows that not all amount of a Si—O based oxide contained the alkoxysilane solution applied becomes the first film 13*a* and/or the second film 13*b*.

Next, a resin solution is prepared. The resin solution may be added with a curing agent in addition to the above-mentioned epoxy resin and/or imide resin. The curing agent may be any agent, such as epichlorohydrin. The resin solution has any solvent, but preferably has a volatile solvent, such as acetone and ethanol. Preferably, a total concentration of the resin and the curing agent is 0.01 to 0.1 wt % with respect to 100 wt % of the whole of the resin solution.

Next, the resin solution and the powders with the first film 13*a* and the second film 13*b* are mixed, and granules are obtained by volatilizing the solvent of the resin solution. The resulting granules may be filled in a die as they are, but may be filled in a die after being sized. The resulting granules may be sized by any method, such as a method using a mesh whose mesh size is 45 to 500 μm.

Next, the resulting granules are filled in a die having a predetermined shape and are pressed, and a pressed powder is obtained. The granules are pressed at any pressure, such as 600 to 1500 MPa.

The manufactured pressed powder is subjected to a heat curing treatment, and a dust core is obtained. The heat curing treatment is carried out with any conditions. For example, the heat curing treatment is carried out at 150 to 220° C. for 1 to 10 hours. Moreover, the heat curing treatment is carried out in any atmosphere, such as air.

The dust core according to the present embodiment and a method of manufacturing it are described above, but the dust core and the method of manufacturing it of the present invention are not limited to the above-mentioned embodiment. Incidentally, the dust core of the present invention may be a soft magnetic dust core.

The dust core of the present invention is used for any purpose, such as for coil devices of inductors, choke coils, transformers, etc.

EXAMPLES

Hereinafter, the present invention is described based on more detailed examples, but is not limited thereto.

Experimental Example 1

As a metal magnetic material, manufactured were Fe—Si based alloy particles where Si/Fe=4.5/95.5 was satisfied by weight ratio and the total amount of Fe and Si was 99 wt %. Incidentally, the median (D50) of particle sizes of the Fe—Si based alloy particles was 30 μm.

In order that a first film was formed on the metal magnetic material, a wet application was subsequently carried out by wet spraying an alkoxysilane solution against the metal magnetic material. Incidentally, the alkoxysilane solution was 50 wt % solution of trimethoxysilane.

Here, the wet spray was carried out by 5 mL/min, and the application time was adjusted as necessary.

The powder after the wet spray was subjected to a heat treatment at 800° C. for 1 to 12 hours in air, and a first film comprising a Si—O based oxide was formed.

Next, a wet application was carried out by once again wet spraying the alkoxysilane solution, which had been used to form the first film, against the metal magnetic material with the first film. The wet spray was carried out by 5 mL/min, and the application time was adjusted as necessary. Then, the powder after the wet spray was subjected to a heat treatment at 500° C. for 0.5 to 2 hours in air, and a second film comprising a Si—O based oxide was formed.

To obtain film thickness of each example shown in Table 1 to Table 3, the spray amount (application amount) of the alkoxysilane solution during the wet spray was controlled by spray time (application time) in the formation of the first film and the second film mentioned above. Incidentally, the second spray of the alkoxysilane solution and the second heat treatment were not carried out in Comparative Example "A".

Next, a resin solution was formed by mixing an epoxy resin, a curing agent, an imide resin, and an acetone. The epoxy resin was cresol novolac. The curing agent was epichlorohydrin. The imide resin was bismaleimide. Each of the components was mixed so that a weight ratio of the epoxy resin, the curing agent, and the imide resin was 96:3:1, and that a total of the epoxy resin, the curing agent, and the imide resin was 4 wt % with respect to 100 wt % of the whole of the resin solution.

The above-mentioned metal magnetic material with the first film and the second film was mixed with the above-mentioned resin solution. Next, granules were obtained by volatilizing the acetone. Next, the granules were sized using a mesh whose mesh size was 355 The resulting granules were filled in a toroidal die whose outer diameter was 17.5 mm and inner diameter was 11.0 mm and were pressed at 980 MPa, and a pressed powder was obtained. The granules were filled so that the weight of the pressed powder was 5 g. Next, a heat curing treatment was carried out by heating the resulting pressed powder at 200° C. for 5 hours in air, and a dust core was obtained. The curing treatment was carried out so that the amount of the metal magnetic material was about 97 wt % with respect to 100 wt % of the entire dust core finally obtained.

<Distinction Between First Film and Second Film>

Figure 3:
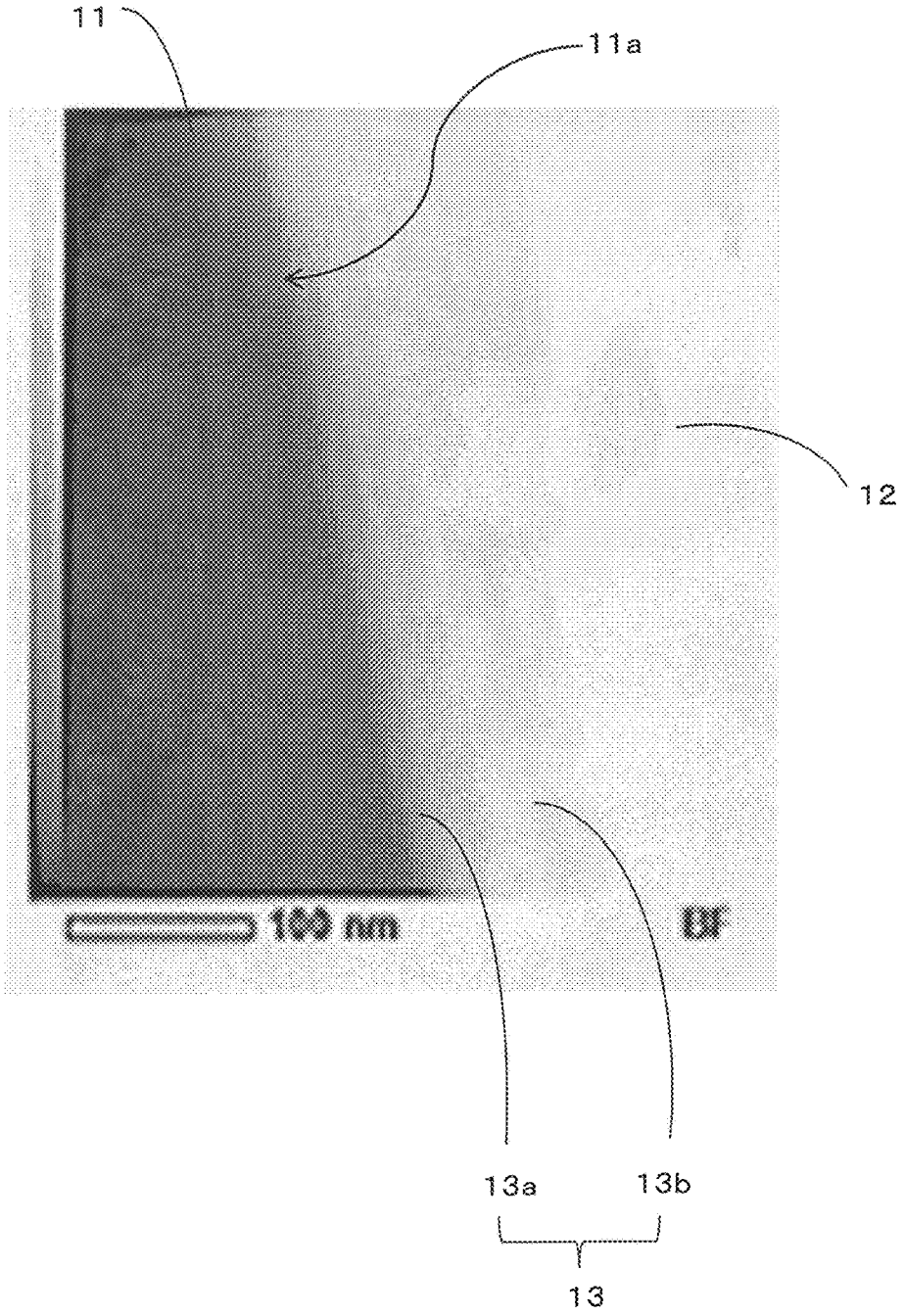
FIG. 3 is a TEM image obtained by TEM observation near a surface of a metal magnetic material.

The resulting dust core was cut and polished, and a cross section of the dust core was exposed. The exposed cross section was drilled by Focused Ion Beam (FIB) so as to cut out a flake whose area was 1 μm×1 μm and thickness was 100 nm. The resulting flake was observed by TEM and subjected to an image analysis in a visual field of 500 nm×500 nm. FIG. 3 is an actual result of image analysis (TEM observation) of Example 30 of Table 2.

First, it was confirmed by TEM-EDS observation that there was an insulation film containing Si and O and covering the metal magnetic material. Moreover, it was confirmed by TEM observation that the insulation film comprised two films having different contrasts.

Here, among the two films, a film contacting with the surface of the metal magnetic material was considered to be a first film, and a film contacting with the surface of the first film was considered to be a second film.

In all Examples of the present application, including Example 30, the first film was a relatively dark visual field, and the second film was a relatively bright visual field. Incidentally, as understood from FIG. 3, the metal magnetic material had the darkest visual field and the resin had the brightest visual field in the image obtained by TEM observation. That is, the metal magnetic material, the first film, the second film, and the resin were darker in this order in the image obtained by TEM observation. On the other hand, no second film was present and only a metal magnetic material, a first film, and a resin were observed in Comparative Example "A".

<Measurement of Si Detection Intensity Ratio>

Si detection intensities of the first film and the second film were measured by TEM-EDS analysis. Si detection intensities of the first film were measured randomly at 10 points of the first film. An average of the Si detection intensities at the 10 points was considered to be $I_1$. Likewise, Si detection intensities of the second film were measured randomly at 10 points of the second film, and an average of the Si detection intensities at the 10 points was considered to be $I_2$. Then, $I_1/I_2$ was calculated.

<Measurement of Film Thickness>

Film thicknesses of the first film and the second film were measured by TEM observation. A measurement point was set on the surface of the metal magnetic material. Then, a perpendicular line was drawn from the measurement point toward the first film and the second film, and a length of the perpendicular line in the first film was considered to be a thickness of the first film at the measurement point. Likewise, a length of the perpendicular line in the second film was considered to be a thickness of the second film at the measurement point. 10 measurement points were set, and thicknesses of the first film and the second film were measured at each measurement point. Then, an average of the thicknesses of the first film was defined as $D_1$, and an average of the thicknesses of the second film was defined as $D_2$. Then, $D_1/D_2$ was calculated.

<Measurement of DC Superposition Characteristics>

In the toroidal dust core obtained in each example, the winding number was set to 50 turns, and initial permeability was measured by LCR meter (LCR428A manufactured by HP). The change in initial permeability was observed by changing a DC magnetic field to be applied between 0 to 20000 A/m. A value ($H_{\mu i*0.8}$) of DC magnetic field when initial permeability became $\mu_i$*0.8 was evaluated, where $\mu_i$ was initial permeability when no DC magnetic field was applied. When $H_{\mu i*0.8} \geq 4500$ A/m was satisfied, DC superposition characteristics were considered to be good. When $H_{\mu i*0.8} \geq 10000$ A/m was satisfied, DC superposition characteristics were considered to be better. When $H_{\mu i*0.8} \geq 12000$ A/m was satisfied, DC superposition characteristics were considered to be still better.

TABLE 1

| | wet spray time of first film h | heating time of first film h | wet spray time of second film h | heating time of second film h | I1/I2 | D1 nm | D2 nm | D1/D2 | total film thickness nm | $H_{\mu i*0.8}$ A/m |
|---|---|---|---|---|---|---|---|---|---|---|
| Comp. Ex. "A" | 0.3 | 6 | 0 | 0 | — | 12 | 0 | — | 12 | 2375 |
| Ex. 1 | 5.0 | 6 | 0.1 | 1 | 1.77 | 198 | 3 | 66.0 | 201 | 10714 |
| Ex. 2 | 4.8 | 6 | 0.3 | 1 | 1.76 | 190 | 9 | 21.1 | 199 | 11111 |
| Ex. 3 | 4.3 | 6 | 0.4 | 1 | 1.79 | 172 | 17 | 10.1 | 189 | 11538 |
| Ex. 4 | 4.6 | 6 | 0.6 | 1 | 1.75 | 182 | 19 | 9.58 | 201 | 12821 |
| Ex. 5 | 3.9 | 6 | 1.3 | 1 | 1.75 | 156 | 42 | 3.71 | 198 | 12195 |
| Ex. 6 | 3.0 | 6 | 2.5 | 1 | 1.77 | 119 | 82 | 1.45 | 201 | 12800 |
| Ex. 7 | 1.9 | 6 | 3.5 | 1 | 1.72 | 75 | 117 | 0.64 | 192 | 13120 |
| Ex. 8 | 1.6 | 6 | 4.0 | 1 | 1.75 | 63 | 132 | 0.48 | 195 | 13540 |
| Ex. 9 | 1.0 | 6 | 4.7 | 1 | 1.80 | 41 | 156 | 0.26 | 197 | 14286 |
| Ex. 10 | 0.9 | 6 | 4.9 | 1 | 1.77 | 34 | 162 | 0.21 | 196 | 14200 |
| Ex. 11 | 0.5 | 6 | 5.2 | 1 | 1.80 | 21 | 173 | 0.12 | 194 | 14286 |
| Ex. 12 | 0.4 | 6 | 5.3 | 1 | 1.77 | 14 | 183 | 0.077 | 197 | 12245 |
| Ex. 13 | 0.3 | 6 | 5.5 | 1 | 1.75 | 13 | 184 | 0.071 | 197 | 11111 |
| Ex. 14 | 0.2 | 6 | 5.7 | 1 | 1.80 | 9 | 192 | 0.047 | 201 | 10520 |
| Ex. 15 | 0.1 | 6 | 5.9 | 1 | 1.77 | 6 | 196 | 0.031 | 202 | 10310 |

TABLE 2

| | wet spray time of first film h | heating time of first film h | wet spray time of second film h | heating time of second film h | I1/I2 | D1 nm | D2 nm | D1/D2 | total film thickness nm | $H_{\mu i*0.8}$ A/m |
|---|---|---|---|---|---|---|---|---|---|---|
| Ex. 21 | 0.3 | 6 | 0.1 | 1 | 1.78 | 11 | 3 | 3.667 | 14 | 12195 |
| Ex. 22 | 0.3 | 6 | 0.2 | 1 | 1.75 | 12 | 6 | 2.000 | 18 | 12640 |
| Ex. 23 | 0.3 | 6 | 0.3 | 1 | 1.77 | 13 | 9 | 1.444 | 22 | 12821 |
| Ex. 24 | 0.3 | 6 | 0.4 | 1 | 1.77 | 12 | 14 | 0.857 | 26 | 12195 |
| Ex. 25 | 0.3 | 6 | 0.8 | 1 | 1.76 | 13 | 27 | 0.481 | 40 | 12821 |
| Ex. 26 | 0.3 | 6 | 1.2 | 1 | 1.79 | 15 | 39 | 0.385 | 54 | 12941 |
| Ex. 27 | 0.3 | 6 | 2.0 | 1 | 1.75 | 16 | 65 | 0.246 | 81 | 13514 |
| Ex. 28 | 0.3 | 6 | 2.4 | 1 | 1.77 | 15 | 81 | 0.185 | 96 | 12195 |
| Ex. 29 | 0.3 | 6 | 2.7 | 1 | 1.77 | 12 | 91 | 0.132 | 103 | 13095 |
| Ex. 30 | 0.3 | 6 | 3.6 | 1 | 1.77 | 12 | 121 | 0.099 | 133 | 12766 |
| Ex. 31 | 0.3 | 6 | 4.3 | 1 | 1.75 | 13 | 143 | 0.091 | 156 | 13043 |
| Ex. 32 | 0.3 | 6 | 5.2 | 1 | 1.78 | 13 | 174 | 0.076 | 187 | 12500 |
| Ex. 33 | 0.3 | 6 | 5.3 | 1 | 1.80 | 13 | 176 | 0.074 | 189 | 10976 |
| Ex. 34 | 0.3 | 6 | 5.6 | 1 | 1.78 | 12 | 186 | 0.065 | 198 | 10588 |
| Ex. 35 | 0.3 | 6 | 5.7 | 1 | 1.80 | 13 | 191 | 0.068 | 204 | 10239 |
| Ex. 36 | 0.3 | 6 | 6.0 | 1 | 1.80 | 13 | 201 | 0.065 | 214 | 10540 |
| Ex. 37 | 0.3 | 6 | 9.0 | 1 | 1.78 | 12 | 300 | 0.040 | 312 | 10671 |

TABLE 3

| | wet spray time of first film h | heating time of first film h | wet spray time of second film h | heating time of second film h | I1/I2 | D1 nm | D2 nm | D1/D2 | total film thickness nm | $H_{\mu i*0.8}$ A/m |
|---|---|---|---|---|---|---|---|---|---|---|
| Ex. 41 | 0.2 | 6 | 1.9 | 1 | 1.75 | 6 | 62 | 0.097 | 68 | 12326 |
| Ex. 42 | 0.3 | 6 | 3.6 | 1 | 1.80 | 13 | 120 | 0.108 | 133 | 12245 |
| Ex. 43 | 0.5 | 6 | 6.9 | 1 | 1.77 | 20 | 230 | 0.087 | 250 | 12162 |
| Ex. 44 | 0.8 | 6 | 9.8 | 1 | 1.76 | 31 | 326 | 0.095 | 357 | 12045 |
| Ex. 45 | 1.1 | 6 | 13.8 | 1 | 1.78 | 42 | 461 | 0.091 | 503 | 13043 |

Examples 1 to 15 of Table 1 were examples where $D_1/D_2$ was changed while a total film thickness ($D_1+D_2$) was fixed to around 200 nm. Examples 21 to 37 of Table 2 were examples where $D_2$ was changed while $D_1$ was fixed to around 12 nm. Examples 41 to 45 of Table 3 were examples where a total film thickness was changed while $D_1/D_2$ was fixed to around 0.09. In all of the examples, the density of the first film was higher than the density of the second film. Since the density of the first film was higher than the density of the second film, the first film had a dark visual field compared to the second film. Moreover, since $1.25<I_1/I_2<10.0$ was satisfied, DC superposition characteristics were better. On the other hand, DC superposition characteristics were poor in Comparative Example "A" of Table 1, where no second film was present.

Moreover, DC superposition characteristics were still better in Examples 4 to 12, 21 to 32, and 41 to 45, where $0.075<D_1/D_2<10.0$ was satisfied.

Experimental Example 2

In the present experimental example, $I_1/I_2$ was changed by changing heat treatment conditions after wet spray of an alkoxysilane solution, and examples and comparative examples were manufactured. The results are shown in Table 4 and Table 5. In Table 4, the wet application time of the first film was fixed to 0.3 hours, and the wet application time of the second film was fixed to 6.1 hours. In Table 5, the wet application time of the first film was fixed to 4.3 hours, and the wet application time of the second film was fixed to 5.2 hours.

TABLE 4

| | wet spray time of first film h | heating time of first film h | wet spray time of second film h | heating time of second film h | I1/I2 | D1 nm | D2 nm | D1/D2 | total film thickness nm | $H_{\mu i*0.8}$ A/m |
|---|---|---|---|---|---|---|---|---|---|---|
| Ex. 50a | 0.3 | 12 | 6.1 | 0.5 | 10.32 | 11 | 205 | 0.054 | 216 | 8696 |
| Ex. 51 | 0.3 | 12 | 6.1 | 1 | 9.92 | 12 | 200 | 0.060 | 212 | 10714 |
| Ex. 52 | 0.3 | 12 | 6.1 | 2 | 5.43 | 13 | 202 | 0.064 | 215 | 11111 |
| Ex. 53 | 0.3 | 9 | 6.1 | 0.5 | 3.32 | 11 | 193 | 0.057 | 204 | 11950 |
| Ex. 54 | 0.3 | 9 | 6.1 | 1 | 2.66 | 13 | 208 | 0.063 | 221 | 11890 |
| Ex. 54a | 0.3 | 9 | 6.1 | 2 | 2.32 | 13 | 204 | 0.064 | 217 | 11850 |
| Ex. 55 | 0.3 | 6 | 6.1 | 0.5 | 2.25 | 12 | 198 | 0.061 | 210 | 11750 |
| Ex. 56 | 0.3 | 6 | 6.1 | 1 | 1.80 | 12 | 188 | 0.064 | 200 | 10345 |
| Ex. 57 | 0.3 | 6 | 6.1 | 2 | 1.56 | 12 | 194 | 0.061 | 206 | 10215 |
| Ex. 59 | 0.3 | 3 | 6.1 | 0.5 | 1.26 | 13 | 195 | 0.069 | 208 | 11500 |
| Ex. 50b | 0.3 | 3 | 6.1 | 1 | 1.22 | 13 | 196 | 0.066 | 209 | 6667 |
| Ex. 50c | 0.3 | 3 | 6.1 | 2 | 1.20 | 11 | 199 | 0.055 | 210 | 4762 |
| Comp. Ex. 4 | 0.3 | 1 | 6.1 | 0.5 | 1.00 | 12 | 190 | 0.063 | 202 | 2941 |
| Comp. Ex. 6 | 0.3 | 1 | 6.1 | 2 | 0.85 | 10 | 192 | 0.052 | 202 | 1235 |

TABLE 5

| | wet spray time of first film h | heating time of first film h | wet spray time of second film h | heating time of second film h | I1/I2 | D1 nm | D2 nm | D1/D2 | total film thickness nm | $H_{\mu i*0.8}$ A/m |
|---|---|---|---|---|---|---|---|---|---|---|
| Ex. 60a | 4.3 | 12 | 5.2 | 0.5 | 10.32 | 23 | 174 | 0.134 | 197 | 9696 |
| Ex. 61 | 4.3 | 12 | 5.2 | 1 | 9.92 | 24 | 173 | 0.136 | 197 | 12214 |
| Ex. 62 | 4.3 | 12 | 5.2 | 2 | 5.43 | 24 | 173 | 0.137 | 197 | 12611 |
| Ex. 63 | 4.3 | 9 | 5.2 | 0.5 | 3.32 | 23 | 172 | 0.135 | 196 | 13450 |
| Ex. 64 | 4.3 | 9 | 5.2 | 1 | 2.66 | 24 | 174 | 0.137 | 198 | 13390 |
| Ex. 64a | 4.3 | 9 | 5.2 | 2 | 2.52 | 23 | 172 | 0.134 | 195 | 13350 |
| Ex. 65 | 4.3 | 6 | 5.2 | 0.5 | 2.25 | 24 | 173 | 0.136 | 196 | 13250 |
| Ex. 66 | 4.3 | 6 | 5.2 | 1 | 1.80 | 24 | 172 | 0.137 | 195 | 13998 |
| Ex. 67 | 4.3 | 6 | 5.2 | 2 | 1.56 | 23 | 172 | 0.136 | 196 | 13730 |
| Ex. 69 | 4.3 | 3 | 5.2 | 0.5 | 1.26 | 24 | 173 | 0.139 | 196 | 13000 |
| Ex. 60b | 4.3 | 3 | 5.2 | 1 | 1.22 | 24 | 173 | 0.138 | 196 | 8167 |
| Ex. 60c | 4.3 | 3 | 5.3 | 2 | 1.20 | 23 | 173 | 0.134 | 196 | 6262 |
| Comp. Ex. 14 | 4.3 | 1 | 5.2 | 0.5 | 1.00 | 24 | 172 | 0.137 | 196 | 4441 |
| Comp. Ex. 16 | 4.3 | 1 | 5.2 | 2 | 0.85 | 23 | 172 | 0.133 | 195 | 2735 |

In each example of Table 4 and Table 5, the density of the first film was higher than the density of the second film. Since the density of the first film was higher than the density of the second film, the first film had a dark visual field compared to the second film. Moreover, $I_1/I_2>1.00$ was satisfied. Then, DC superposition characteristics were good. In Examples 51 to 59 and 61 to 69, where $1.25<I_1/I_2<10.0$ was satisfied, DC superposition characteristics were better. In Examples 61 to 69, where $1.25<I_1/I_2<10.0$ and $0.075<D1/D2<10.0$ were satisfied, DC superposition characteristics were still better. On the other hand, Comparative Examples 4 and 14, where the density of the first film and the density of the second film were similar to each other, $I_1/I_2=1.00$ was satisfied. In Comparative Examples 6 and 16, where the density of the second film was higher than the density of the first film, $I_1/I_2\leq1.00$ was satisfied, and the second film had a dark visual field compared to the first film. Then, DC superposition characteristics of Comparative Examples 4, 6, 14, and 16 were inferior to those of Examples.

Experimental Example 3

The present experimental example was carried out in a similar manner to Experimental Example 1 except that no alkoxysilane solution was wet sprayed against the metal magnetic material, and that no insulation film was formed. As a result, when no insulation film was present, the metal magnetic material was hard to be molded, and a dust core could not be manufactured.

NUMERICAL REFERENCES

1 . . . dust core
11 . . . metal magnetic material
11*a* . . . surface of metal magnetic material 11
12 . . . resin
13 . . . insulation film
13*a* . . . first film
13*b* . . . second film

The invention claimed is:

1. A dust core comprising:
a metal magnetic particle;
a resin; and
an insulation film contacting with a surface of the metal magnetic particle and covering the metal magnetic particle,
wherein the insulation film comprises:
a first film contacting with the surface of the metal magnetic particle; and
a second film contacting with a surface of the first film,
wherein the first film and the second film are made of a same material, and
wherein a density of the first film is higher than a density of the second film.

2. The dust core according to claim 1, wherein each of the first film and the second film comprises a Si—O based oxide.

3. The dust core according to claim 2, wherein the first film and the second film comprise different contrasts from each other observed by TEM.

4. The dust core according to claim 2, wherein $1.25<I_1/I_2<10.0$ is satisfied, where $I_1$ is a Si detection intensity of the first film, and $I_2$ is a Si detection intensity of the second film, in TEM-EDS analysis of the first film and the second film.

5. The dust core according to claim 3, wherein $1.25<I_1/I_2<10.0$ is satisfied, where $I_1$ is a Si detection intensity of the first film, and $I_2$ is a Si detection intensity of the second film, in TEM-EDS analysis of the first film and the second film.

6. The dust core according to claim 1, wherein $0.075<D_1/D_2<10.0$ is satisfied, where $D_1$ is a thickness of the first film, and $D_2$ is a thickness of the second film.

7. The dust core according to claim 2, wherein $0.075<D_1/D_2<10.0$ is satisfied, where $D_1$ is a thickness of the first film, and $D_2$ is a thickness of the second film.

8. The dust core according to claim 3, wherein $0.075<D_1/D_2<10.0$ is satisfied, where $D_1$ is a thickness of the first film, and $D_2$ is a thickness of the second film.

9. The dust core according to claim 4, wherein $0.075<D_1/D_2<10.0$ is satisfied, where $D_1$ is a thickness of the first film, and $D_2$ is a thickness of the second film.

10. The dust core according to claim 5, wherein $0.075<D_1/D_2<10.0$ is satisfied, where $D_1$ is a thickness of the first film, and $D_2$ is a thickness of the second film.

11. The dust core according to claim 1, wherein the metal magnetic particle comprises a main component of Fe.

12. The dust core according to claim 2, wherein the metal magnetic particle comprises a main component of Fe.

13. The dust core according to claim 3, wherein the metal magnetic particle comprises a main component of Fe.

14. The dust core according to claim 4, wherein the metal magnetic particle comprises a main component of Fe.

15. The dust core according to claim 6, wherein the metal magnetic particle comprises a main component of Fe.

16. The dust core according to claim 1, wherein the metal magnetic particle comprises a main component of Fe and Si.

17. The dust core according to claim 2, wherein the metal magnetic particle comprises a main component of Fe and Si.

18. The dust core according to claim 3, wherein the metal magnetic particle comprises a main component of Fe and Si.

19. The dust core according to claim 4, wherein the metal magnetic particle comprises a main component of Fe and Si.

* * * * *